US006051929A

United States Patent [19]

Genz et al.

[11] Patent Number: 6,051,929

[45] Date of Patent: Apr. 18, 2000

[54] DIRECT-CURRENT ARC LAMP

[75] Inventors: Andreas Genz; Frank Werner, both of Berlin, Germany

[73] Assignee: Patent-Treuhand-Gesellschaft für elecktrische Glühlampen m.b.H., Munich, Germany

[21] Appl. No.: 09/041,511

[22] Filed: Mar. 12, 1998

[30] Foreign Application Priority Data

Apr. 4, 1997 [DE] Germany ..... 197 14 009

[51] Int. Cl.[7] ..... H01J 17/20

[52] U.S. Cl. ..... 313/639; 313/573; 313/640

[58] Field of Search ..... 313/493, 573, 313/634, 637, 638, 639, 640, 642, 112, 635

[56] References Cited

U.S. PATENT DOCUMENTS

| | | | |
|---|---|---|---|
| 2,965,790 | 12/1960 | Ittig et al. . | |
| 4,360,756 | 11/1982 | Spencer et al. | 313/579 |
| 4,686,419 | 8/1987 | Block et al. . | |
| 4,935,668 | 6/1990 | Hansler et al. . | |
| 4,937,496 | 6/1990 | Neiger et al. | 313/637 |

FOREIGN PATENT DOCUMENTS

| | | |
|---|---|---|
| 0220633 | 5/1987 | European Pat. Off. . |
| 0623945 | 11/1994 | European Pat. Off. . |
| 0641015 | 3/1995 | European Pat. Off. . |
| 0678898 | 10/1995 | European Pat. Off. . |
| 0714118 | 5/1996 | European Pat. Off. . |
| 0715 339 42 | 6/1996 | European Pat. Off. . |
| 1254794 | 5/1961 | France . |
| 288229 | 10/1915 | Germany . |
| 902528 | 1/1954 | Germany . |
| 21 02 112 | 9/1971 | Germany . |
| 25 10 145 | 9/1975 | Germany . |
| 29 53 446 C2 | 7/1980 | Germany . |
| 30 44 184 A1 | 6/1982 | Germany . |
| 32 08 647 A1 | 9/1983 | Germany . |
| 35 06 295 A1 | 8/1986 | Germany . |
| 600495 | 4/1948 | United Kingdom . |
| 689962 | 4/1953 | United Kingdom . |

*Primary Examiner*—Vip Patel

*Attorney, Agent, or Firm*—Frishauf, Holtz, Goodman, Langer & Chick, P.C.

[57] ABSTRACT

The metal-halide direct-current arc discharge lamp has a fill system which has cadmium and/or zinc as components of the central fill in addition to an ignition gas, mercury, and a halogen. Preferably, the fill is retained in a bulb (10) which is asymmetrical with respect to a central plane (1) perpendicular to a longitudinal axis (2) of the lamp. The lamp is particularly suitable for use in combination with an optical projection system (R), especially when operating in horizontal position.

20 Claims, 1 Drawing Sheet

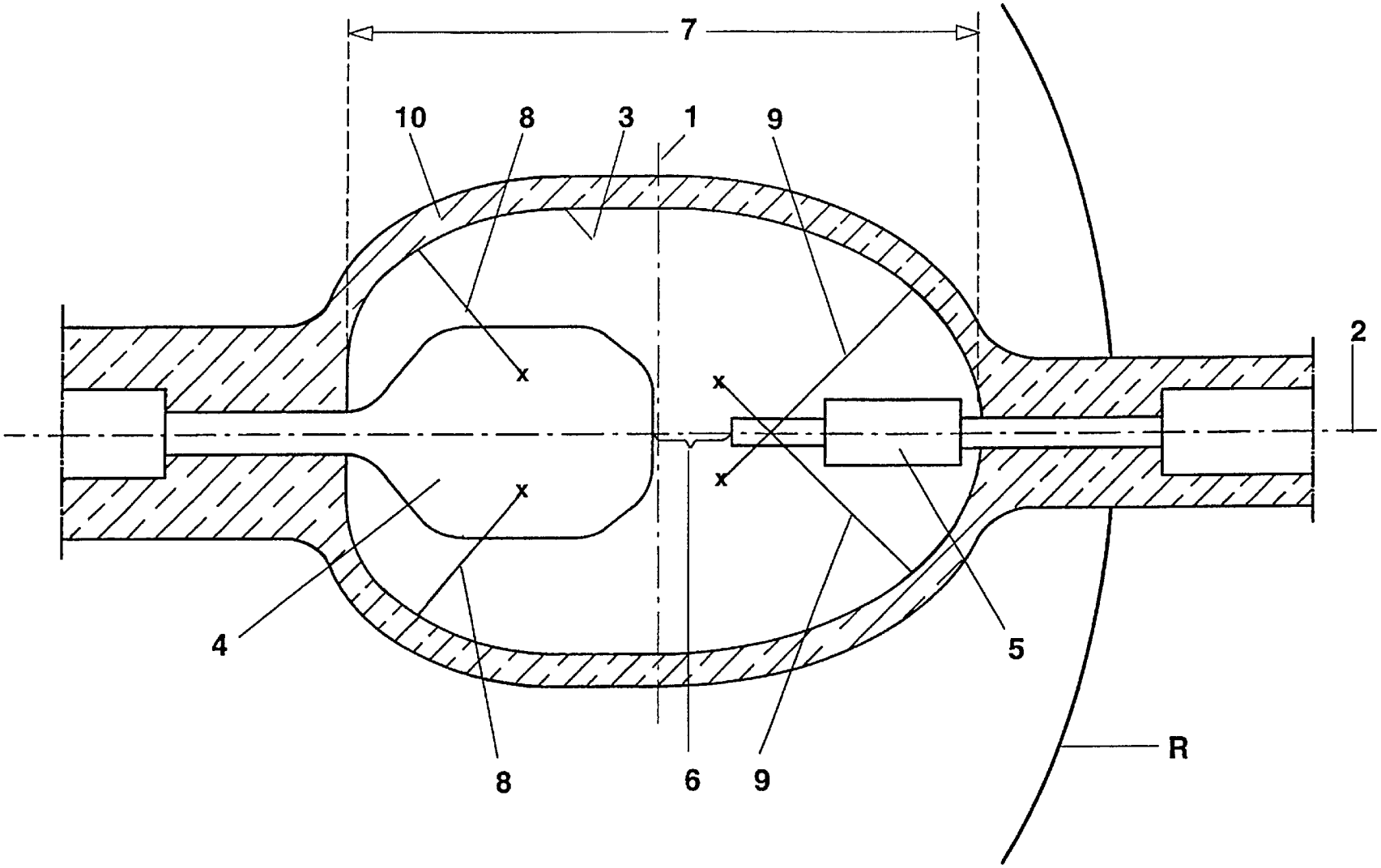
2
R
5
9
9
7
1
6
3
8
8
10
4

DIRECT-CURRENT ARC LAMP

Reference to related patents and applications, the disclosures of which are hereby incorporated by reference:

U.S. Ser. No. 09/041,512, filed Mar. 12, 1998, GENZ et al. (claiming priority German Appln. 197 14 008.4 of Apr. 4, 1997) assigned to the assignee of the present application.

U.S. Pat. No. 2,965,790, ITTIG et al.

U.S. Pat. No. 4,686,419, BLOCK et al.

Reference to related patent disclosures:

German 288,229, NERNST

German 902,528, DOERING

German 21 02 112, HELLMAN

German 29 53 446 C2, KATSUO et al.

German 30 44 184 A1, MUTZHAS

German 32 08 647 A1, DOBRUSSKIN et al.

German 25 10 145, WESSELINK et al.

FIELD OF THE INVENTION

The present invention relates to a direct-current arc lamp, and more particularly to a direct-current arc lamp especially suitable for use in optical systems, such as projection systems.

BACKGROUND

There has recently been an increased interest in the improvement of direct-current arc lamps, particulary arc lamps used in combination with optical systems for projection use. When projecting images, it is important that the light generation occur localized highly concentrated and, additionally, that the light which is generated in this localized region be homogeneous. The color separation effect becomes material. The color separation effect can be described as a localized separation, with respect to different spectral regions or colors of the overall light respectively. This localized separation of specific colors within the overall light being generated decreases the quality of light for projection uses, since color boundaries will result at limiting or end or edge regions of projected pictures, slides or images. The color separation effect is generated by the electrical direct-current field which arises during operation of the lamp between the anode and cathode of a direct-current arc lamp. This electric direct-current field influences the distribution of concentration of metal ions which generate the light, between anode and cathode. Thus, the spatial distribution of metal ions between the anode and cathode may become non-homogeneous. Different metal ions may be subject to different distributions of concentration. The respective different metal ions provide different spectral contributions to the overall light output of the lamp and these differences then lead to the undesired color separation effect.

The direct-current arc lamp forming the subject matter of this invention uses a fill containing halogen. During operation of the lamp, metal halides within the discharge vessel will arise. Metal halides have a higher vapor pressure than the corresponding elementary metals. At high arc power, typically about 80 W per millimeter of arc length and more, the light generating metal halides will generate high vapor pressures. This ensures, on the one hand, high light output from the lamp; on the other hand, however, the high vapor pressure enhances, usually, also the color separation effect.

Further criteria for quality of a lamp—not only for projection use—are sufficient proportions of the base colors blue, green and red to ensure good color rendition and a desirable color temperature.

SUMMARY OF THE INVENTION

It is an object to solve the technical problem of providing a direct-current arc lamp with improved operating characteristics, particularly for projection use, and to provide an improved projection system.

Briefly, the direct-current arc lamp has a fill containing at least the following components: a starting gas, mercury, and a halogen, and further, in accordance with a feature of the invention, the fill contains cadmium and/or zinc. Such a lamp, in accordance with a feature of the invention, is used and incorporated in a projection system.

When light is generated for use in a projection system, it has been found that it is critical to have a sufficient proportion of red within the overall light spectrum. This, on the one hand, ensures good reproduction of red colors and, on the other, permits setting the color temperature between about 5,000 and 8,000 K, and, preferably, between 6,000 and 7,000 K.

In accordance with a feature of the present invention, the red component in the generated light can be obtained by introducing lithium within the fill of the direct-current arc discharge lamp. Lithium, as has been found, primarily has a very long wave emission which leads to a deep red component. In all uses, which are intended for a specific visual effect, for example in projection, or also for general illumination, it is necessary to consider not only the purely physical spectral proportions of the light but, also, the physiological sensitivity of the human eye. This sensitivity is usually represented by a V ($\lambda$) or brightness sensitivity curve. The spectral sensitivity of the human eye substantially decreases at the long wave edge. Thus, if the red component is based on lithium emission, a correspondingly increased spectral power must be generated in order to provide for the desired light flux.

It has been found also that addition of lithium to the lamp fill also increases the above-described color separation effect.

The fill of a metal halide d-c arc discharge lamp includes an ignition gas, such as argon, a halogen (for example bromine or iodine) and mercury, in order to build up the necessary arc voltage. The green color component of the mercury must be considered in the overall light distribution. The green component, derived from the mercury, must be compensated by red when balancing the color temperature. This complicates the problem with red components in the light.

In accordance with a feature of the present invention, cadmium (Cd) or zinc (Zn) are used in the lamp fill since, entirely surprisingly, these additives not only increase the red spectral component but, additionally, decrease the color separation effect. Adding cadmium or zinc, thus, permits substantial improvement with respect to the color separation problem in comparison to only adding lithium for the red portion, and, with same power rating of a lamp, results in increased light output.

Using mercury in combination with the present invention as an alternative to the two 2B elements cadmium and zinc is not suitable, since it excessively accentuates the green component of the light although, to a certain extent, it also decreases the color separation effect.

Zinc has the advantage with respect to cadmium and mercury because of its better environmental acceptability. Cadmium is of advantage for particular applications, since the red-reproduction is improved. In accordance with the present invention, and with respect to specific lamps, the decision whether to use cadmium or zinc can be based on whether optimal lamp performance or environmental considerations are paramount.

In accordance with a feature of the invention, preferred concentrations for cadmium or zinc, respectively, are 0.05 to 3.0 μmol/ml of the volume of the discharge vessel.

The following ranges of concentration for cadmium or zinc, respectively, have been found particularly suitable for lamps of different power ratings, when combined with a projection system:

| Rated Lamp Power | Concentration in μmol/ml | Use |
|---|---|---|
| up to 170 W | 0.3 to 3.0 | Home and General Applications |
| 170 to 300 W | 0.2 to 2.0 | Business Use |
| 300 to 3,000 W | 0.05 to 1.0 | Professional Large-Screen Projection |

It is to be understood that the above-given values are only approximate. The data on concentration relate to the sum of the individual concentrations of cadmium or zinc, respectively, in which the concentration of one of these two individual components may be zero.

In accordance with a further feature of the invention, yttrium may be used as yet another additive, together with the basic composition of the fill. For one, an improvement in light flux or light output is obtained. As a second advantage, the lifetime of the lampsis improved and, as a third one, the light flux or light output decreases to a smaller extent as the lamp ages. Yttrium, however, is not a necessary additive to obtain the basic improvements in accordance with the invention; however it has been found, surprisingly, to be particularly effective with the components in accordance with the invention, with respect to light output, lifetime, and resistance to aging effects.

Further optional additives can be considered, particularly for control of the color temperature and enhancement of base colors. The above discussion of the disadvantage of lithium should not be understood to exclude lithium from embodiments of the present invention. Lithium may be present, in predetermined quantities, as a portion of the red component; by use of cadmium or zinc, respectively, in accordance with the present invention, the quantities of lithium required are less than heretofore used.

In accordance with a preferred use, a high proportion of blue in the spectrum is frequently desired. In accordance with a feature of the invention, the preferred component to provide blue within the spectrum is indium.

Other optional additives, primarily to increase light output, are the rare-earth metals, primarily dysprosium and/or thallium.

The halogens which are preferred to determine the desired vapor pressures by forming metal halide components are, respectively, iodine and/or bromine.

The geometric shape of the lamp is another aspect of the invention besides the fill system.

In many uses, and particularly in projection systems, the light generation should be localized as precisely as possible and should be as small as possible. Short-arc discharge lamps provide comparatively small, constricted light sources. The arc length should be as short as possible, so that the light source can approach a point source reasonably well, thereby obtaining good optical quality upon projection, or for other uses in combination with an optical system on, or through which, light, generated by the lamp, is being directed.

In addition to localizing the light source, the light should be generated uniformly throughout its entire physical extent. For good localization of arcs, such as is the case in short-arc lamps, the temperature distribution within the lamp, and particularly at the inside wall of the bulb, in accordance with the invention, has been found to be of substantial importance. This temperature distribution primarily affects the temperature gradients along the path within the lamp between cathode and anode. These temperature gradients can be substantially reduced by suitably selecting the geometric shape of the lamp bulb which retains a gas fill. In accordance with a feature of the invention, the asymmetry of the lamp bulb is matched to the asymmetry of the temperature distribution of the electrodes in a direct-current arc lamp.

It is well known that the anode of direct-current arc lamps, for example short-arc lamps, is loaded thermally much higher than the cathode, and therefore also becomes much hotter. To be able to withstand this additional heat, the anode of direct-current short-arc lamps is usually substantially more massive or larger than the cathode. Usually, the anode is of essentially cylindrical shape with a substantially greater diameter than the cathode.

Investigations of lamp temperatures have found that the inner wall of the bulb in the vicinity of the anode is subjected to substantially higher temperature than in the region of the cathode, if the bulb is symmetrical, as it was in the prior art, apparently due to not only the higher anode temperature, but also to the substantially larger diameter of the anode itself. This larger anode diameter leads to a shorter distance of the anode surface from the inner wall of the bulb; additionally, the heat-conductive and heat-radiating surface of the anode is substantially higher than that of the cathode. This temperature difference also influences the physical parameters of the discharge and the generation of the light due to the arc. In accordance with a feature of the invention, the lamp is specifically so shaped that the temperature difference between the hottest and coolest locations at the inner wall of the bulb will be as small as possible, and preferably essentially zero. The light emission, in accordance with the invention, will become more homogeneous if the temperature distribution is essentially uniform. With a non-symmetrical bulb shape, it is also possible to adjust the temperature to an optimum value which meets the requirements of light flux or light output, as well as lifetime and low aging factor or maintenance factor.

If the temperature distribution within the bulb is non-uniform, and particularly if comparatively large temperature differences obtain, coatings or deposits can form at the colder locations of the inner wall of the bulb. These deposits arise due to condensed components of the fill or electrode material. The electrodes, usually, are made of tungsten. Condensed and deposited components can act similar to an interference filter. This leads, during the lifetime of the lamp, to increased spectral non-homogeneity of the light distribution and light output of the lamp. Deposits of electrode material decrease the light output from the regions of the inner wall of the bulb from which electrode material has deposited, and thus decrease the overall light flux of the lamp during its lifetime. Both effects, together, lead to poor ageing characteristics, that is, to poor light maintenance during the lifetime of the lamp. The lifetime of the lamp, additionally, is decreased by increased devitrification of the light bulb at the hottest locations thereof. This undesirable effect depends on the absolute value of the temperature distribution, as well as on the temperature differences in the inner wall of the bulb, which again is dependent on the shape of the lamp. The temperature distribution and temperature differences can be influenced by suitably arranging the geometric dimensions of the lamp with respect to the power rating of the fill within the lamp.

The homogeneity of temperature distribution within the lamp, in accordance with a feature of the invention, is increased by so shaping the bulb that the inner wall surrounding the anode is wider than the portion of the inner wall surrounding the cathode. The exact shape is dependent on the shape of the electrodes, and further must be suitably selected so that the bulb can be easily made. The temperature homogeneity can be obtained by various concretely established geometrical shapes. A preferred shape is that which is geometrically simple, so that the bulb can be easily manufactured.

When using the bulb in a projection system, as noted, the arc length should be as short as possible. The arc length of course has a relationship to the power rating of the lamp. In accordance with a feature of the invention, short-arc lamps which have ratings of more than 80, 100, 120, or preferably 150 watts/millimeter (arc length) are particularly preferred. Reference to the size of the bulb is not appropriate, since the size of the bulb is determined by the thermal loading of the material of the bulb as such, and thus depends strongly on the characteristics of this bulb material. There are continued improvements in materials, for example use of ceramics rather than quartz glass, and as materials improve, the size of the bulb itself may become substantially smaller than currently in use.

Regions and ranges for the asymmetry of the shape of the bulb can be described by the relationship of a longitudinally sectioned half-surface with respect to the vicinity of the anode and cathode. As more specifically described in the example below, these half-surfaces are surfaces which, in longitudinal section (of the lamp), are on both sides of a plane which includes the longitudinal lamp axis and generally centrally intersects the length of the bulb. Additionally, these surfaces include generally half of the length of the longitudinal axis of the lamp and are, further, delimited by the inner wall of the bulb. The relationship of these half-surfaces is preferably more than 1.1, and preferably below 1.5.

Usually, lamp bulb manufacturing and shaping machines use forms and shapes which have bulb molds corresponding to the bulb shape, in order to simplify shaped manufacture. The inner surfaces can be described, in longitudinal section, by radii of curvature. In accordance with a feature of the invention, the end portions of the bulb adjacent the anode, and adjacent the cathode, respectively, can be described by radii of curvature corresponding to a longitudinal section—as will be described in detail below. In accordance with a feature of the invention, the longitudinal section radius of curvature at the anode end portion is smaller than that at the cathode end portion, preferably 50%–80% that of the cathode portion. This means that the bulb, at the anode portion, is more curved than at the cathode portion, which is somewhat more shallow. This results in a wider bulb shape at the anode portion. It is to be noted that the centers of curvature of the longitudinal section above and below or right and left of the longitudinal axis need not coincide, and further that the centers of curvature for the anode portion and the cathode portion may be at different locations with respect to the longitudinal axis. Otherwise, due to the smaller radius of curvature, a narrower shape of the bulb would result.

The object to be achieved in accordance with the invention, namely to decrease temperature gradients in the lamp, could in principle also be obtained by use of a suitable reflective and/or absorbing heat damming or heat radiation resistant coating at the cathode side of the inner wall of the bulb. Such a coating could, in general principle, also be used as a feature in addition to the asymmetry of the bulb in accordance with the present invention. It is, however, preferred not to use such a heat damming or heat controlling coating since, by eliminating such a coating, manufacture of the lamp can be simplified by at least one production step or process step. The asymmetry of the bulb can be readily achieved by suitably shaping the usual shaping tools and dies or molds which are used in a lamp bulb manufacturing machine, without however in any way otherwise interfering with the conventional manufacturing process or changing a conventional manufacturing process. Not using heat controlling coatings has the further advantage that shading and decreased light output is avoided.

BRIEF DESCRIPTION OF THE DRAWING

The single figure is a highly schematic longitudinal cross-sectional view through a direct-current discharge lamp.

DETAILED DESCRIPTION OF THE LAMP STRUCTURE

The lamp has a longitudinal axis 2. An anode 4 and a cathode 5 are located coaxially with the axis 2. The space within the bulb 10 is defined by the inner wall 3 of the bulb 10. The length of the inner space of the bulb is shown by dimension line 7. A separating plane 1 divides this length in half. Plane 1 is perpendicular to the longitudinal lamp axis 2. The plane 1 is within the length of the arc, which arises in operation of the lamp.

The figure clearly shows that, with respect to this generally central plane 1, the bulb is asymmetrically shaped. In longitudinal section, the half-surface at the anode differs from the half-surface at the cathode. In the drawing, these half-surfaces are located, respectively, at the left and at the right from the central plane 1, and correspond to the longitudinal cross-sectional region within the inner wall 3 of the bulb 10.

The figure also clearly shows that the curvature of the bulb at the anode side, in longitudinal section, illustrated by the radius of curvature 8, is substantially more curved than the curvature at the cathode side, shown by the cathode radius of curvature 9. Preferably, the radius of curvature 8 is between 50 and 80% of the radius of curvature 9. The drawing also clearly shows that the respective centers of curvature above and below the longitudinal axis 2 are not in alignment in the direction of the longitudinal axis, but rather the centers of curvature of the radii 8 and 9, for the anode and cathode, respectively, are at different locations in relation to the longitudinal axis 2, as well as with respect to the central plane 1. The lap is rotationally symmetric with respect to the longitudinal axis 2.

The asymmetrical shape of the bulb has as a result that the much thicker anode 4—with respect to the cathode 5—is spaced from the inner wall 3 of the bulb by a sufficient distance so that the temperature distribution, in longitudinal direction, within the lamp is essentially uniform.

The drawing also shows that the space between the anode 4 and the cathode 5, that is, the arc length 6, is short, in the present case 1.5 mm, compared with a radius 8 of 4 mm and a radius 9 of 6 mm, respectively, for a lamp rated at 270 W. The specific power is 180 W/mm arc length. The inner length 7 of the bulb 10 is just under 10 times the length of the arc 6. This results in an arc voltage of 35 V, while providing light output of 18 klm. The fill volume is 0.7 ml, and the wall loading is 65 W/cm$^2$.

In this lamp, a color temperature of 6,800 K is obtained with the following fill:

200 mbar argon 20 mg mercury 0.11 mg cadmium iodide ($CdI_2$), corresponding to about 0.43 $\mu$mol cadmium per ml volume of the bulb 0.42 mg mercury bromide ($HgBr_2$)

0.12 mg mercury iodide ($HgI_2$)

0.05 mg indium iodide ($InI_2$)

0.05 mg lithium iodide ($LiI_2$)

0.11 mg dysprosium 0.05 mg yttrium.

In the foregoing formulation, cadmium could be mol-equivalently replaced by zinc. Thallium iodide ($ThI_2$) could be added up to about 0.2 mg/ml.

The lamp is particularly suitable for use with an optical system. This optical system is, highly schematically, represented by a reflector R. When the lamp is installed in horizontal position, the reflector would be seen in cross section. Since the reflector as such, however, does not form part of the present invention, it is shown only schematically for ease of illustration. Of course, the optical system may also be formed by, or include, lenses or the like.

It should be noted, as apparent in the single figure, that the plane 1 which is perpendicular to the longitudinal axis 2 intersects that longitudinal axis within the region of the arc 6, although not necessarily in the center of the arc region.

Various changes and modifications may be made, and any features described herein can be used separately or, in accordance with the invention, in other combinations.

We claim:

1. A direct-current arc lamp having a color temperature above 5000° K., comprising:

a bulb (10) defining a longitudinal bulb axis (2), an anode (4) and a cathode (5), said anode and said cathode being located in the bulb facing each other and aligned along said axis (2); and a fill retained in said lamp, wherein said fill comprises
an ignition gas,
mercury,
at least one halide,
and zinc.

2. The lamp of claim 1, wherein the fill further includes yttrium.

3. The lamp of claim 2, wherein the fill further includes cadmium.

4. The lamp of claim 1, wherein the fill further includes lithium.

5. The lamp of claim 1, wherein the fill further includes indium.

6. The lamp of claim 1, wherein the fill further includes a rare-earth metal.

7. The lamp of claim 6, wherein said rare-earth metal comprises dysprosium.

8. The lamp of claim 7, wherein the ignition gas comprises argon; the at least one halide comprises mercury bromide, mercury iodide, indium iodide and lithium iodide; and the fill further includes yttrium.

9. The lamp of claim 1, wherein the fill further includes thallium.

10. The lamp of claim 1, wherein the at least one halide is selected from the group consisting of an iodine halide and a bromine halide.

11. The lamp of claim 1, wherein the concentration of said zinc is between 0.05 and 3.0 $\mu$mol per ml of the volume of said lamp bulb (10).

12. The lamp of claim 11, wherein a region of concentration of said zinc, in dependence on the rated lamp power of the lamp, is defined by the following table:

| Rated Lamp Power | Concentration in $\mu$mol/ml |
|---|---|
| up to 170 W | 0.3 to 3.0 |
| 170 to 300 W | 0.2 to 2.0 |
| 300 to 3,000 W | 0.05 to 1.0 |

13. The lamp of claim 1, further including a heat damming or heat retention coating applied to one side of the wall defining said bulb.

14. The lamp of claim 1, wherein the fill further includes cadmium.

15. The lamp of claim 14, wherein said zinc and cadmium are contained in a total concentration of between 0.05 to 3.0 $\mu$mol per $\mu$l of the volume of said lamp bulb.

16. The lamp of claim 15, wherein a region of concentration of said zinc and said cadmium, in dependence on the rated lamp power of the lamp, is defined by the following table:

| Rated Lamp Power | Concentration in $\mu$mol/ml |
|---|---|
| up to 170 W | 0.3 to 3.0 |
| 170 to 300 W | 0.2 to 2.0 |
| 300 to 3,000 W | 0.05 to 1.0 |

17. The lamp of claim 1, wherein the lamp has a color temperature of 5000 to 8000° K.

18. The lamp of claim 1, wherein the lamp has a color temperature of 6000 to 7000° K.

19. The combination of the lamp as claimed in claim 1 with an optical system (R), receiving, in operation of the lamp, light from said lamp.

20. The combination of claim 19, wherein said lamp is positioned, with respect to said optical system (R), with the longitudinal bulb axis (2) located horizontally.

* * * * *